US007712873B2

(12) United States Patent
Chikamoto

(10) Patent No.: US 7,712,873 B2
(45) Date of Patent: May 11, 2010

(54) INKJET HEAD

(75) Inventor: Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/414,416

(22) Filed: Mar. 30, 2009

(65) Prior Publication Data

US 2009/0185008 A1 Jul. 23, 2009

Related U.S. Application Data

(62) Division of application No. 11/387,855, filed on Mar. 24, 2006, now Pat. No. 7,530,677.

(30) Foreign Application Priority Data

Mar. 24, 2005 (JP) ..... 2005-085798

(51) Int. Cl.
*B41J 2/04* (2006.01)
*B41J 2/175* (2006.01)

(52) U.S. Cl. ..... 347/54; 347/93

(58) Field of Classification Search ..... 347/71, 347/93

See application file for complete search history.

(56) References Cited

U.S. PATENT DOCUMENTS 5,489,930 A 2/1996 Anderson
7,044,591 B2 * 5/2006 Taira ..... 347/93
2004/0165028 A1 8/2004 Ito et al.
2005/0073562 A1 * 4/2005 Taira ..... 347/93
2005/0083379 A1 4/2005 Chikamoto

FOREIGN PATENT DOCUMENTS

EP 1403603 A1 3/2004
EP 1506867 A1 2/2005
JP 2005-059438 A 3/2005

OTHER PUBLICATIONS

European Patent Office, European Search Report for European Patent Application No. EP06005493, dated Sep. 1, 2006. (Counterpart to above-captioned U.S. Divisional Patent Application.).

* cited by examiner

*Primary Examiner*—Matthew Luu
*Assistant Examiner*—Lisa M Solomon
(74) *Attorney, Agent, or Firm*—Baker Botts L.L.P.

(57) ABSTRACT

An inkjet head includes a flow path unit, an actuator unit, a flat flexile cable, a cover member and plural filters. The actuator unit is joined to an inflow-port face of the flow path unit. The reservoir unit supplies ink in an ink reservoir thereof into the flow path unit through the filters against which a region of the reservoir unit at least partially abuts. A side face of the reservoir unit defines a recess reaching the region of the reservoir unit between adjacent two filters. A sealant is applied to a gap between side faces of the two adjacent filters on the inflow-port face of the flow path unit and applied to the recess.

2 Claims, 13 Drawing Sheets

INKJET HEAD

CROSS-REFERENCE TO RELATED APPLICATIONS

This application is the divisional application of U.S. patent application Ser. No. 11/387,855, filed Mar. 24, 2006, which claims the benefit of Japanese Patent Application No. 2005-085798, filed Mar. 24, 2005, the disclosures of which are incorporated herein by reference in their entirety.

BACKGROUND OF THE INVENTION

1. Field of the Invention

The invention relates to an inkjet head, which ejects ink to a recording medium.

2. Description of the Related Art

US 2005/0083379 A1 discloses an inkjet head, which ejects ink from nozzles to a recording medium such as a printing sheet. The inkjet head has a flow path unit, a reservoir unit and an actuator unit. The flow path unit is formed with a common ink chamber and a plurality of individual ink flow paths that communicate with the common ink chamber while reaching nozzles via respective pressure chambers. The reservoir unit has a reservoir for supplying a stored ink to the common ink chamber. The reservoir unit is joined to the flow path unit. The actuator unit applies an ejection energy to the ink in the flow path unit. A filter for removing dust or the like staying in the ink is also placed in the reservoir.

SUMMARY OF THE INVENTION

However, dust or the like, which passes through the filter placed in the reservoir, may enter the individual ink flow paths that are minute flow paths. Complicated and minute flow paths are formed in the flow path unit. Therefore, it is relatively difficult to place in the flow path unit a filter for preventing dust from entering into the individual ink flow paths.

The invention provides an inkjet head in which entering of dust or the like into individual ink flow paths can be suppressed by a simple configuration.

According to one embodiment of the invention, an inkjet head includes a flow path unit, an actuator unit, a plurality of filters, a reservoir unit, a flexible flat cable, a cover member and a sealant. The flow path unit includes a plurality of ink inflow ports, a common ink chamber and a plurality of individual ink flow paths. Ink flowing into the ink inflow ports is supplied to the common ink chamber. Each of individual ink flow paths extends from an outlet of the common ink chamber to a nozzle through a pressure chamber. The actuator unit applies an ejection energy to the ink in the pressure chambers. The actuator unit is joined to an inflow-port face of the flow path unit in which the ink inflow ports are formed. The filters are joined to the inflow-port face of the flow path unit. The filters cover the ink inflow ports. The reservoir unit is formed with an ink reservoir that stores the ink. The reservoir unit includes a first face, a second face opposite to the first face and a side face connecting the first face and the second face. The second face includes a first region and a second region. The first region at least partially faces the actuator unit with a gap therebetween. The second region at least partially abuts against the filters. The side face defines a first recess and a second recess.

The first recess reaches the first region of the second face. The second recess reaches the second region of the second face between adjacent two filters. The reservoir unit supplies the ink in the ink reservoir into the flow path unit through the filters. The flat flexible cable includes a fixed portion and a extending portion. The fixed portion is fixed to the actuator unit. The extending portion is withdrawn from the fixed portion and extends in a direction away from the flow path unit. The cover member includes an end face and an accommodation region. The end face abuts against the first face of the reservoir unit. The accommodation region is accommodated in the first recess. The extending portion of the flat flexible cable is interposed between the first recess and the accommodation region. The sealant that is applied to a gap between side faces of the two adjacent filters on the inflow-port face of the flow path unit and applied to the second recess.

According to this configuration, entering of dust or the like into the individual ink flow paths can be suppressed by the simple configuration in which the filters are placed between the flow path unit and the reservoir unit. Since the second recess is formed, the sealant for preventing the ink from passing through the gap between two adjacent filters and reaching the actuator unit can be easily applied to the gap between the side faces of the two filters. Thereby, it is possible to prevent ink mist, that is, tiny drops of ink from entering through the gap between two adjacent filters into the inkjet head to damage the actuator unit. Since the cover member partly covers the side face of the reservoir unit, the inkjet head can be miniaturized.

DETAILED DESCRIPTION OF EMBODIMENTS OF THE INVENTION

Hereinafter, embodiments of the invention will be described with reference to the accompanying drawings.

Figure 1:
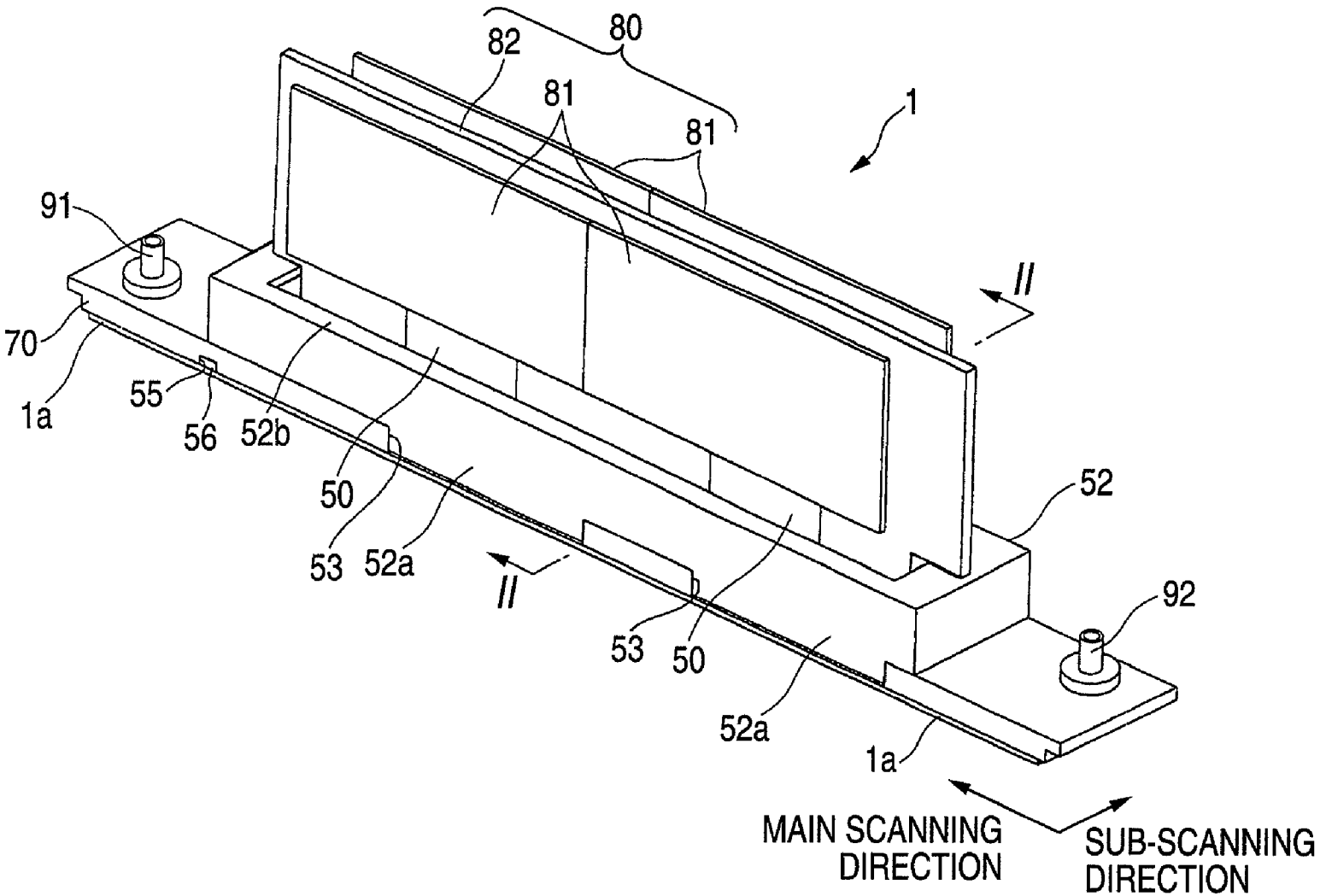
FIG. 1 is a perspective view showing an inkjet head according to one embodiment of the invention.
Figure 2:
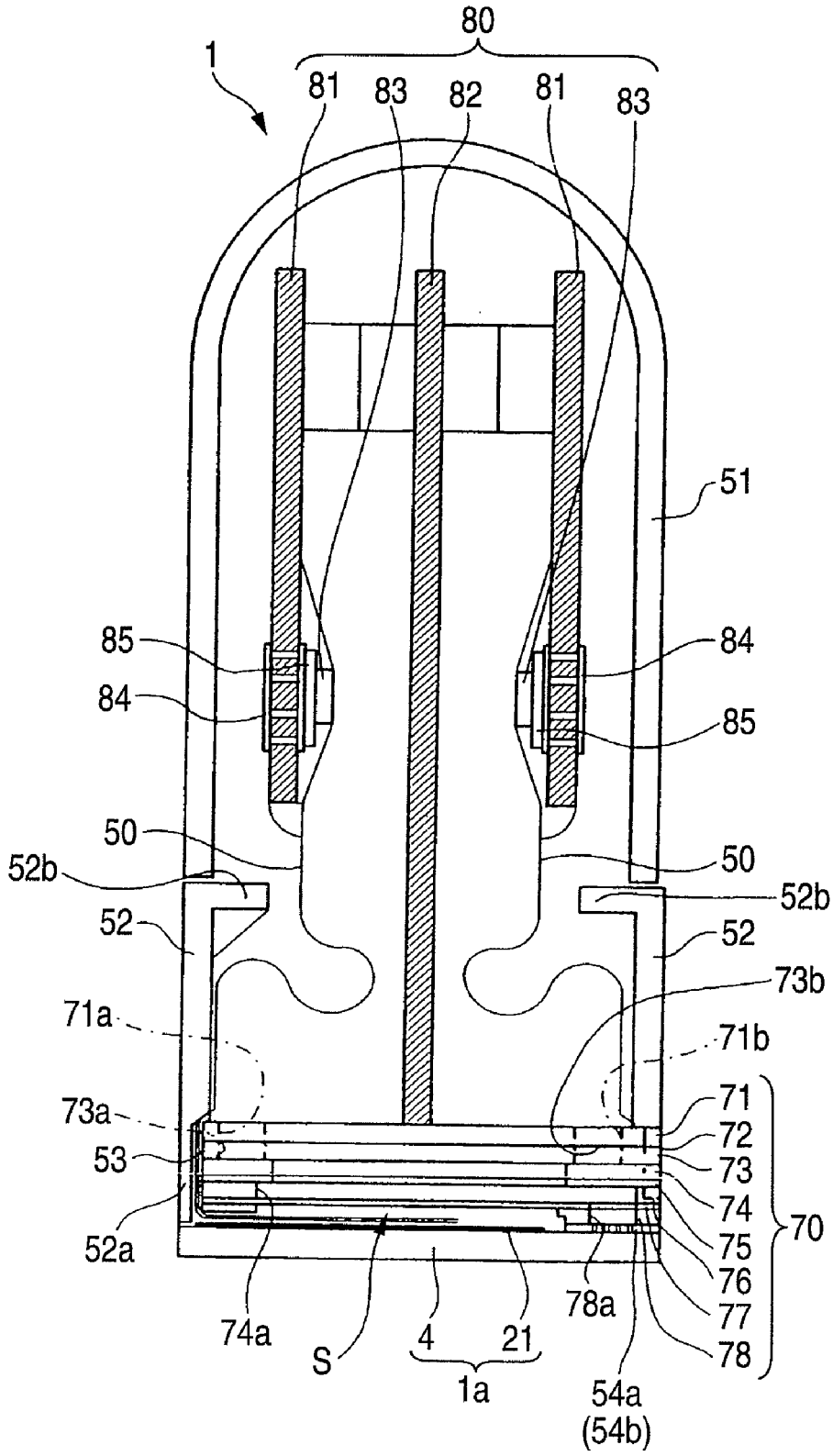
FIG. 2 is a section view of the inkjet head taken along a line II-II of FIG. 1.

FIG. 1 is an external perspective view of an inkjet head 1, which is used in an inkjet printer. FIG. 2 is a section view taken along a line II-II shown in FIG. 1.

As shown in FIGS. 1 and 2, the inkjet head 1 has a shape elongating in a main scanning direction. The inkjet head 1 has a head body 1*a*, a reservoir unit 70, two thin film filters 54*a* and four thin film filters 54*b*, and a control section 80 for controlling driving of the head body 1*a* in order from its bottom. Hereinafter, the components of the inkjet head 1 will be described.

The control section 80 has: a main board 82; sub-boards 81, which are placed on the both sides of the main board 82; and driver ICs 83, which are fixed to side faces of the sub-boards 81 opposed to the main board 82. The driver ICs 83 generate a signal for driving actuator units 21, which are included in the head body 1*a*.

The main board 82 and the sub-boards 81 have a rectangular planes elongating in the main scanning direction, and are upright in parallel to each other. The main board 82 is fixed to the upper face of the reservoir unit 70. The sub-boards 81 are above the reservoir unit 70 and are placed on the both sides of the main board 82 with being separated from the main board 82 by the same distance. The main board 82 and the sub-boards 81 are electrically connected to each other. Heat sinks 84 are fixed to faces of the driver ICs 83 opposed to the sub-boards 81. Specifically, the heat sinks 84 are formed on the both side faces of the sub-boards 81, and the driver ICs 83 are thermally coupled to the heat sinks 84 via thermal conduction sheets 85.

Each of FPCs (Flexible Printed Circuits) 50 function as a power supplying member. One end of each FPC 50, which functions as a fixed portion, horizontally extends along a plane of a flow path unit 4. The fixed portions are fixed and connected to the actuator units 21. Extending portions, which are withdrawn from the fixed portions of the FPCs 50, are bent and extend in a direction (the upward direction in FIG. 2) away from the head body 1*a*. At his time, parts of the extending portions are accommodated in recesses 53 (functioning as first recesses), which are formed in side faces of the reservoir unit 70. The other ends of the FPCs 50 are connected to the sub-boards 81. The FPCs 50 are connected also to the driver ICs 83 on the way from the actuator units 21 to the sub-boards 81. Namely, the FPCs 50 are electrically connected to the sub-boards 81 and the driver ICs 83 to transmit signals output from the sub-boards 81 to the driver ICs 83, and supply driving signals output from the driver ICs 83 to the actuator units 21.

The inkjet head 1 is further provided with an upper cover 51, which covers the control section 80, and a lower cover 52 (functioning as a cover member), which covers a lower portion of the head 1. The covers 51, 52 prevent inks scattering in the printing process from adhering to the control section 80, etc. In FIG. 1, the upper cover 51 is omitted so that the control section 80 can be seen.

As shown in FIG. 2, the upper cover 51 has an arched ceiling, and covers the control section 80. The lower cover 52 has a substantially rectangular cylindrical shape, which is open upward and downward. The lower cover 52 covers a lower portion of the main board 82. In an upper portion of the lower cover 52, upper walls 52*b*, which projects inward from the upper end of the sidewall of the lower cover 52, is formed. The lower end of the upper cover 51 is placed on a portion where the upper wall 52*b* is connected to the sidewall. The lower cover 52 and the upper cover 51 have a substantially same width as that of the head body 1*a*.

In the lower end of each of the both sidewalls (only one of the sidewalls is shown in FIG. 1) of the lower cover 52, two projections 52*a* (functioning as accommodation regions) projecting downward are arranged in the longitudinal direction of the lower cover. The projections 52*a* are placed in the recesses 53 while covering the extending portions of the FPCs 50 accommodated in the recesses 53. Namely, the projections 52*a* face the side faces of the reservoir unit 70 with a gap therebetween. The lower end faces of the sidewalls other than the projections 52*a* abut against the upper face of the reservoir unit 70 (functioning as a first face of the reservoir unit 70). The tip end faces of the projections 52*a* face the flow path unit 4 of the head body 1*a* while forming a gap therebetween for absorbing a production error. A sealant (not shown) is applied between (i) all of the end face of the lower cover 52 and (ii) the reservoir unit 70 and the flow path unit 4. In this embodiment, a sealant made of a soft material is used, and specifically a silicon resin is used for sealing.

Figure 3:
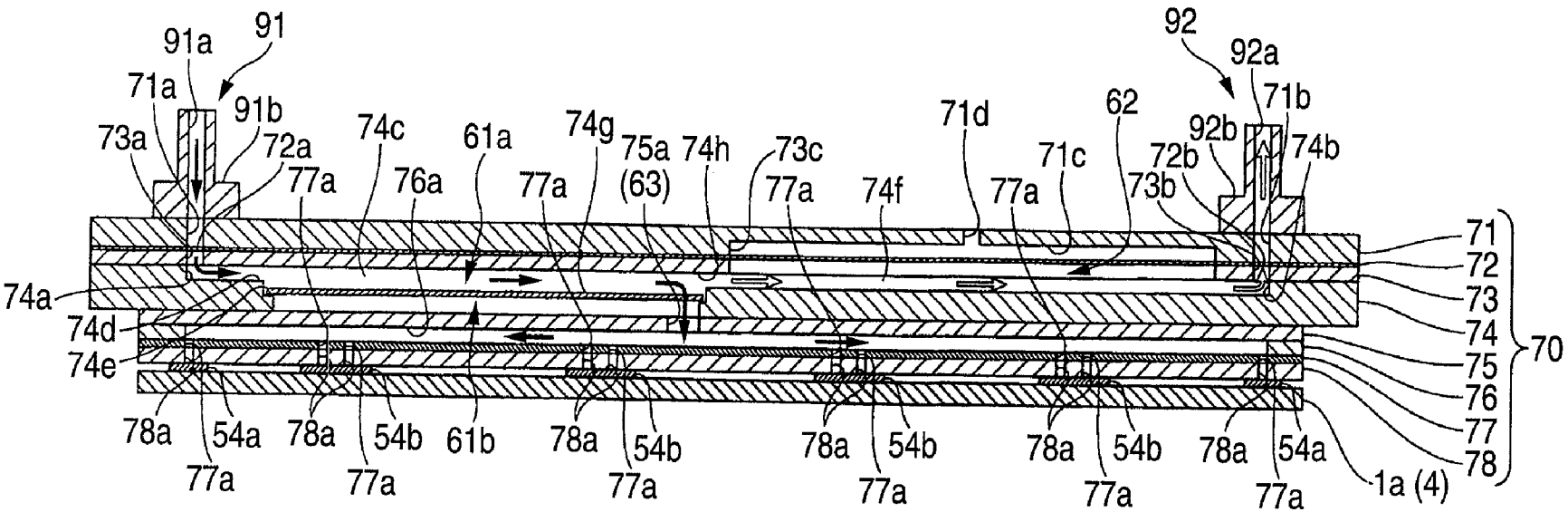
FIG. 3 is a section view of a reservoir unit and a head body, which are shown in FIG. 1, taken along a main scanning direction.

Next, the reservoir unit 70 will be described with further reference to FIGS. 3 and 4. FIG. 3 is a section view of the reservoir unit 70 and the head body 1*a* taken along the main scanning direction. FIG. 4 is an exploded plan view of the reservoir unit 70. In FIG. 3, for the sake of convenience in description, the scale in the vertical direction is expanded, and an ink flow path of the reservoir unit 70, which is not usually shown in a section taken along the same line, is shown desirably.

The reservoir unit 70 temporarily stores ink, and supplies the stored ink to the flow path unit 4 of the head body 1*a*. As shown in FIG. 4, the reservoir unit 70 has a stacked layer structure in which seven plates 71, 73, 74, 75, 76, 77, and 78 that have a rectangular plane elongating in the main scanning direction (see FIG. 1), and one damper sheet 72 are stacked. The seven plates 71, 73 to 78 are plates of a metal such as stainless steel.

Figure 4A:
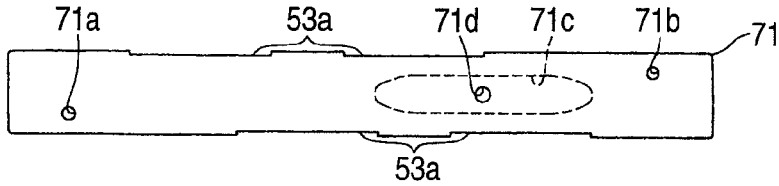
FIGS. 4A to 4H are exploded plan views of the reservoir unit shown in FIG. 3.

In the uppermost first plate 71, as shown in FIGS. 3 and 4A, circular holes 71*a*, 71*b* are formed in the vicinities of one and other ends of the first plate 71 in the longitudinal direction, respectively. The circular holes 71*a*, 71*b* are placed in positions, which are shifted from the center of the first plate 71 in the width direction toward the one and other width ends. An oval recess 71*c*, which elongates in the longitudinal direction of the first plate 71, is formed in the lower face (the face on the side of the damper sheet 72) of the first plate 71. The oval recess 71 c is positioned between the center of the first plate 71 in the longitudinal direction and the circular hole 71*b*. A circular hole 71*d* is formed in the center of the bottom of the oval recess 71*c*. The oval recess 71*c* and the damper sheet 72, which will be described below, constitute a damper chamber.

Figure 4B:
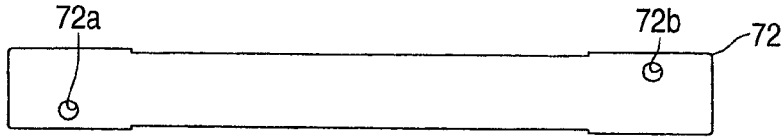

The damper sheet 72, which is the second layer from the top, is made of a flexible thin film member. As shown in FIGS. 3 and 4B, circular holes 72*a*, 72*b* corresponding to the circular holes 71*a*, 71*b* formed in the first plate 71 are formed in the damper sheet 72. The material of the flexible thin film member may be a metal, a resin, or the like, and is not limited those examples so long as it can easily bend in accordance with pressure variation in the ink. In this embodiment, used is a composite resin film in which a gas barrier film is added to a PET (polyethylene terephtalate) resin that originally has an excellent gas barrier property. According to this configuration, transmission of air or steam through the flexible thin film member is very suppressed, and the member functions also as an excellent damper against pressure variation in the ink.

Figure 4C:
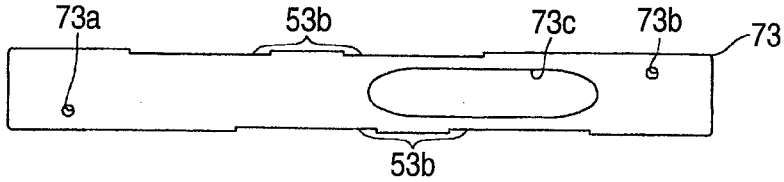

As shown in FIGS. 3 and 4C, circular holes 73*a*, 73*b* corresponding to the circular holes 71*a*, 71*b* formed in the first plate 71; and an oval hole 73*c* corresponding to the oval recess 71*c* formed in the first plate 71 passes through the third plate 73, which is the third layer from the top.

Figure 4D:
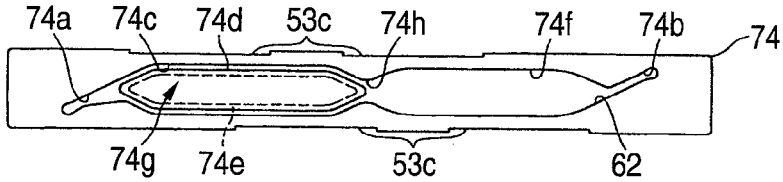

In the fourth plate 74, which is the fourth layer from the top, as shown in FIGS. 3 and 4D, thin recesses 74*a*, 74*b* are formed so as to obliquely elongate toward the center of the fourth plate 74 in the short side direction from regions corresponding to the circular holes 71*a*, 71*b* formed in the first plate 71. Furthermore, an oval hole 74*c*, which elongates to the center of the fourth plate 74 while communicating with the thin recess 74*a*, is formed in the fourth plate 74. Two step faces 74*d*, 74*e*, which have different heights, are formed in the peripheral portion of the oval hole 74*c*. A reservoir filter 74*g*, which removes dust and the like in the ink, is placed on the step face 74*e*, which is lower than the step face 74*d*. Furthermore, an oval recess 74*f*, which elongates to the center of the fourth plate 74 while communicating with the thin recess 74*b*, is formed in the fourth plate 74. The oval recess 74*f*, which is concaved, has a shape and size, which are substantially identical with those of the oval hole 73*c* of the third plate 73. The oval recess 74*f* is open on the side of the third plate 73. The bottom faces of the thin recesses 74*a*, 74*b*; those of the step face 74*d*; and the oval recess 74*f* are formed on the same plane. A damper communication port 74*h* is formed in a sidewall in the vicinity of the center of the fourth plate 74. The oval hole 74*c* and the oval recess 74*f* communicate with each other through the damper communication port 74*h*. The thin recess 74*a*, and the portion of the oval hole 74*c* on the side of the plate 73 with respect to the step face 74*e* form an upstream ink reservoir 61*a*. The oval recess 74*f* and the thin recess 74*b* form a damper flow path 62.

Figure 4E:
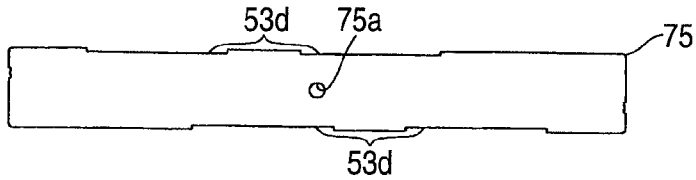

As shown in FIGS. 3 and 4E, a circular hole 75*a* is formed in the center of the fifth plate 75, which is the fifth layer from the top. The circular hole 75*a* forms a drop flow path 63. The fifth plate 75 is stacked from the lower side so that the circular hole 75*a* communicates with the through hole 74*c* of the fourth plate 74. The circular hole 75*a* faces an acute angle portion of the through hole 74*c*, which is on the side of the center of the fourth plate 74.

Figure 4F:
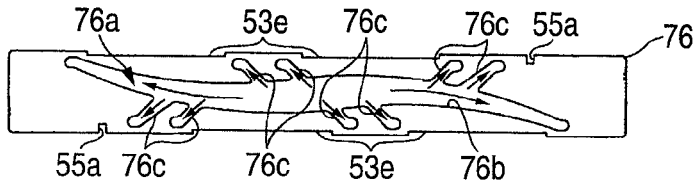

As shown in FIGS. 3 and 4F, a through hole 76*a* is formed in the sixth plate 76, which is the sixth layer from the top. The plan shape of the through hole 76*a* elongates so as to be bent and tapered along the main scanning direction, and symmetric about its center. Specifically, the through hole 76*a* includes a main flow path 76*b*, which elongates in the main scanning direction, and tributary flow paths 76*c*, which diverge from the main flow path 76*b*. The tributary flow paths 76*c* have a flow path width that is smaller than that of the main flow path 76*b*. Each two tributary flow paths 76*c*, which elongate in the same direction, are paired. Two pairs of tributary flow paths 76*c*, which elongate in different directions, elongate from each end of the main flow path 76*b* in the width direction while separating from each other in the longitudinal direction of the main flow path 76*b*. The four pairs of tributary flow paths 76*c* are arranged in a staggered pattern. The portion of the oval hole 74*c* of the fourth plate 74 on the side of the plate 75 with respect to the step face 74*e*, the circular 75*a* of the fifth plate 75, and the through hole 76*a* form a downstream ink reservoir 61*b*. The both ends of the main flow path 76*b* in the longitudinal direction are shifted toward the side opposite to the region corresponding to the circular holes 71*a*, 71*b* of the first plate 71 with respect to the width direction of the sixth plate 76. According to this configuration, the strength of rigidity of the whole reservoir unit 70 is not deviated.

Figure 4G:
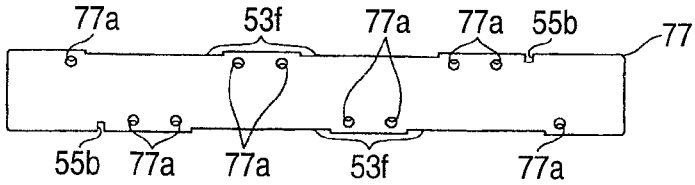

In the seventh plate 77, which is the seventh layer from the top, as shown in FIGS. 3 and 4G, a total of ten circular holes 77*a* are formed in positions corresponding to the both ends of the main flow path 76*b* formed in the sixth plate 76 in the longitudinal direction, and tip end portions of the tributary flow paths 76*c*. Five of the circular holes 77*a* are arranged in the longitudinal direction in the vicinity of each end of the seventh plate 77 in the width direction. Specifically, one, two, and two holes 77*a* are arranged in the one width end in order from one end side (the left side of FIG. 4G) in the longitudinal direction and, one, two, and two holes 77*a* are arranged in the other width end in order from the other end side (the right side of FIG. 4G) in the longitudinal direction, so as to be separated from each other in a staggered manner to avoid notches 53*f*, which will be described later. The circular holes 77*a* are arranged symmetrically about the center of the plate 77.

Figure 4H:
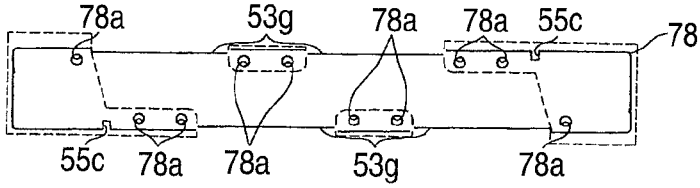

In the eighth plate 78, which is the lowest layer, as shown in FIGS. 3 and 4H, circular holes 78*a* corresponding to the circular holes 77*a* formed in the seventh plate 77 are formed. In the lower face (the face, which is closer to the head body 1*a*) of the eighth plate 78, peripheral portions (portions enclosed by broken lines in the figure) of the circular holes 78*a* project downward. Openings of the circular holes 78*a* in the lower face of the eighth plate 78 function as ink supply ports 59 for supplying the ink to the flow path unit 4.

Figure 5:
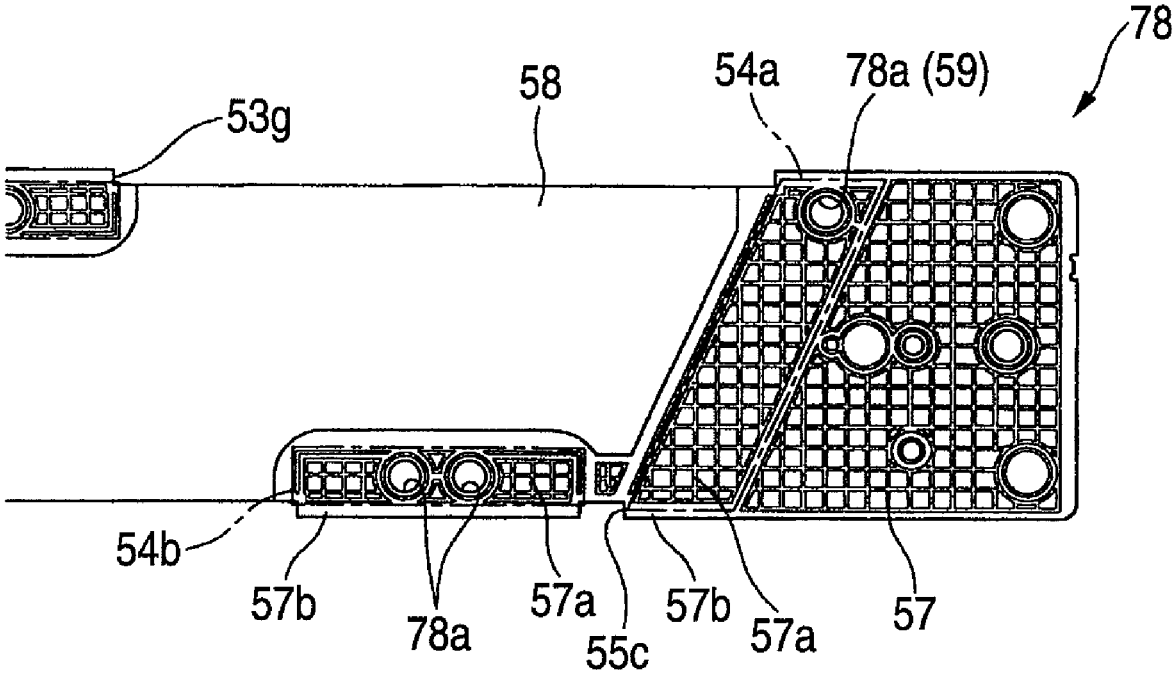
FIG. 5 is a partial plan view of a lower face of a plate shown in FIG. 4H.

The lower face of the eighth plate 78 (functioning as a second face of the reservoir unit 70) will be described with reference to FIG. 5. FIG. 5 is a partial plan view of the lower face of the eighth plate 78. In FIG. 5, a region against which the thin film filters 54*a*, 54*b* abut is indicated by the one-dot chain line. In the lower face of the eighth plate 78, as shown in FIG. 5, surfaces of the downward projecting portions function as second regions 57 at least part of which the thin film filters 54*a*, 54*b* abut against and are joined to by an adhesive agent. The surface other than the downward projecting portions function as a first region 58, which at least partially faces the actuator units 21 with a gap therebetween (see FIGS. 2 and 7). Each of the second regions 57 includes a groove region 57*a* where lattice-like grooves are formed, and a flat non-groove region 57*b* where the lattice-like grooves are not formed. The lower-face openings (the ink supply ports 59) of the circular holes 78*a* are formed in the groove region 57*a*. The thin film filters 54*a*, 54*b* are placed so as to abut against the groove region 57*a* while covering the ink supply ports 59. At this time, the whole circumferences of the outer edges of the thin film filters 54*a*, 54*b* abut against the non-groove region 57*b*. That is, the non-groove region 57*b* has an annular shape along the outer edges of the thin film filters 54*a*, 54*b*.

As shown in FIG. 3, the reservoir unit 70 of this embodiment is configured so that the seven plates 71, 73 to 78 and the one damper sheet 72 are stacked and fixed to each other while being positioned. The side faces of the reservoir unit 70 connect its upper face (first face) and its lower face (second face). As seen from FIG. 4, the three plates 71, 73, 74 are longer in the longitudinal direction than the remaining plates 75 to 78. The inkjet head 1 can be fixed to a fixing portion (not shown) of the printer with using the both end portions of the three plates 71, 73, 74, i.e., the portions which further extend toward the both sides in the longitudinal direction as compared with the plates 75 to 78.

In the both ends of each of the plates 71, 73 to 78 of the width direction, as shown in FIGS. 4A to 4H, two and two or a total of four rectangular notches 53*a* to 53*g* are formed in the longitudinal direction in a staggered pattern. As result of vertically positioning the plates 71, 73 to 78 and the damper sheet 72 with each other, the recesses 53, which elongate from the upper face of the reservoir unit 70 to the first region 58 to penetrate the reservoir unit 70 in the stack direction, are formed by the notches 53*a* to 53*g* (see FIGS. 1, 2, and 7). The width of the reservoir unit 70 except the regions where the recesses 53 are formed is substantially identical with that of the flow path unit 4. In the second regions 57 of the eighth plate 78, in order to prevent the ink from leaking from the ink supply ports 59, a region having a predetermined area is required in the peripheries of the ink supply ports 59. This region is a factor of determining the width of the flow path unit 4. On the other hand, the FPCs 50, which are withdrawn from the actuator units 21, and the projection regions 52*a* of the lower cover 52, which cover FPCs 50, are accommodated in the recesses 53. Therefore, the width of the inkjet head 1 can be reduced to that of the flow path unit 4. Namely, the formation of the recesses 53 enables the inkjet head 1 to be miniaturized. As seen also from FIG. 5, a recess formed by the first region 58 is continuous with the recesses 53 (the notches 53*g*). In this embodiment, the frontages (lengths of the openings in the longitudinal direction) of the recesses 53 are wider than those of openings formed by the first region 58. Since the openings of the recesses 53 are equal to or larger than the openings of the first region 58, the extended portions of the FPCs 50, which are withdrawn from the side of the first region 58 can easily extend upward through the recesses 53.

In each of the ends of the plates 76 to 78, as shown in FIGS. 4F to 4H, each of the rectangular notches 55*a* to 55*c* is formed in a region corresponding to a region between the thin film filter 54*a* and the thin film filter 54*b*, which is closest to the filter 54*a*.

Figure 7:
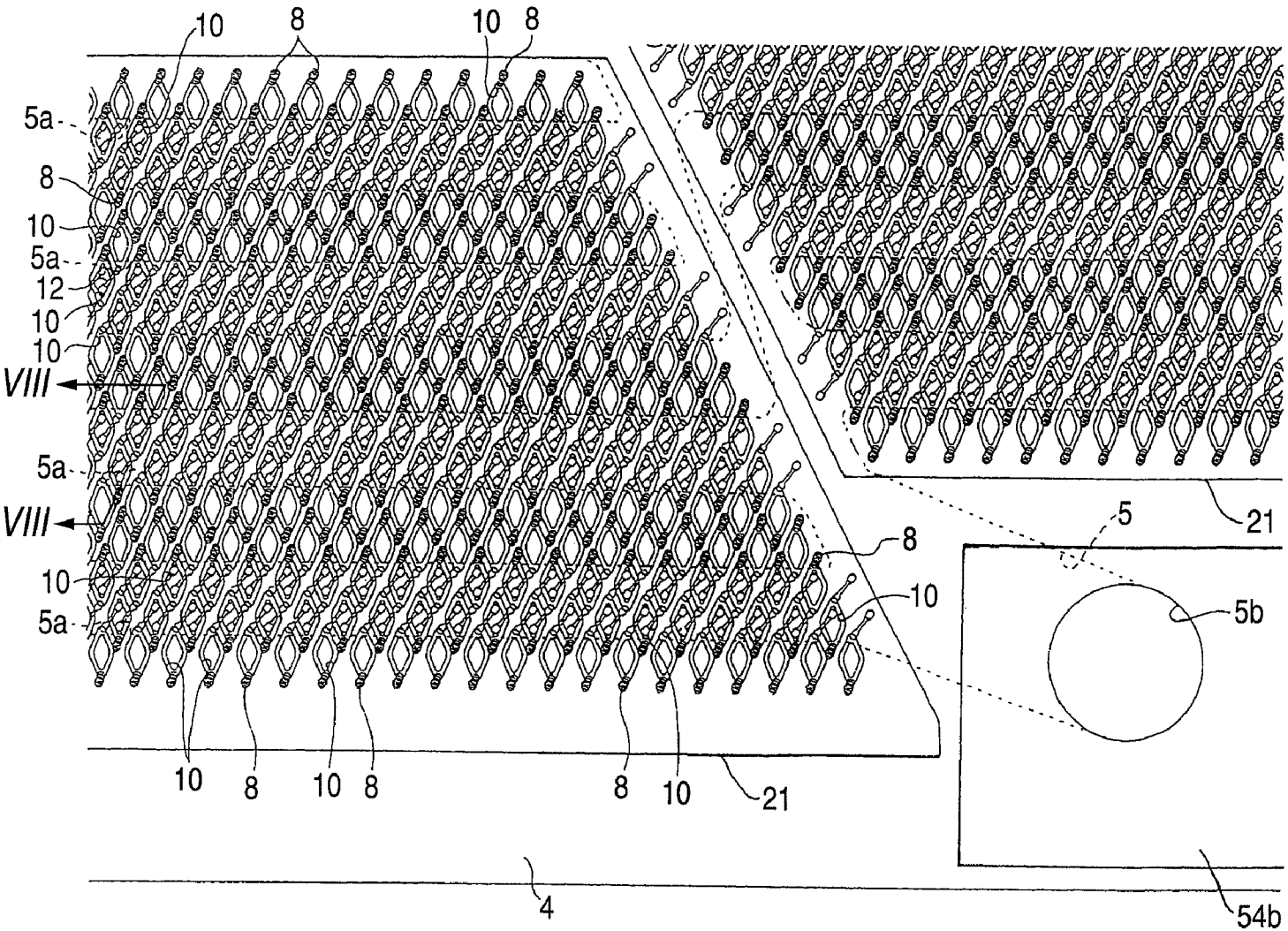
FIG. 7 is an enlarged view of a region enclosed by a one-dot chain line in FIG. 6.

When the plates 76 to 78 are vertically positioned to each other, the notches 55*a* to 55*c* form a recess 55 (functioning as a second recess), which extends from the lower face of the plate 75 to reach the second regions 57 of the plate 78 (see FIGS. 1 and 7).

Next, the ink flow in the reservoir unit 70 when the ink is supplied will be described.

As shown in FIG. 3, a supply joint 91 and a discharge joint 92 are fixed to the positions of the upper face of the first plate 71 where the circular holes 71*a*, 71*b* are formed. The joints 91, 92 are cylindrical members, which have base ends 91*b*, 92*b* having a slightly larger outer diameter. Openings of cylindrical spaces 91*a*, 92*a* in the lower faces of the base ends 91*b*, 92*b* are placed on the upper face of the first plate 71 so as to coincide with the openings of the circular holes 71*a*, 71*b* of the first plate 71, respectively. Hereinafter, the flow (indicated by the solid arrows in FIG. 3) of the ink, which is supplied through the supply joint 91 into the reservoir unit 70, will be described.

As indicated by the solid arrows in FIG. 3, the ink, which has flown into the circular holes 71*a* through the cylindrical space 91*a* of the supply joint 91, flows into the upstream ink reservoir 61*a* through the circular holes 72*a*, 73*a*. The ink, which has flown into the upstream ink reservoir 61*a*, flows into the damper flow path 62 through the damper communication port 74*h*, and passes through the reservoir filter 74*g* and flows into the downstream ink reservoir 61*b*. In the downstream ink reservoir 61*b*, the flow-in ink is caused by the circular hole 75*a* of the fifth plate 75 to drop onto a substantially center of the main flow path 76*b* of the sixth plate 76. As indicated by the arrows in FIG. 4F, thereafter, the ink is directed from the substantially center of the main flow path 76*b* to the both ends of the main flow path 76*b* in the longitudinal direction, and also to the tip ends of the tributary flow paths 76*c*. The ink, which has reached the both ends of the main flow path 76*b* in the longitudinal direction and the tip ends of the tributary flow paths 76*c*, flows into ink inflow ports 5*b* (see FIG. 6), which are open in the upper face of the flow path unit 4, from the ink supply ports 59 through the circular holes 77*a*, 78*a*. In this way, the ink is temporarily stored in the upstream ink reservoir 61*a* and the downstream ink reservoir 61*b*. In the initial process of introducing the ink, the ink, which flows into the damper flow path 62, is discharged to the outside from the discharge joint 92, whereby air bubbles existing in the upstream ink reservoir 61 a and the damper flow path 62 can be easily discharged. Namely, the space on the upstream side of the reservoir filter 74*g* is filled with the ink in a state where there is no residual air bubble.

As shown in FIG. 3, the third plate 73 serves as a flow path wall, which defines the damper flow path 62. The opening of the oval hole 73*c*, which is formed in the flow path wall, is covered by the damper sheet 72. The region of the damper sheet 72, which covers the opening of the oval hole 73*c*, faces the oval recess 71*c* of the first plate 71.

The space, which is defined by the damper sheet 72 and the oval recess 71*c*, forms a damper chamber. The damper chamber communicates with the atmosphere through the circular hole 71*d*. Namely, the damper sheet 72 is interposed between the ink in the damper flow path 62 and the atmosphere. Even when pressure variation occurs in the ink filling the reservoir unit 70, therefore, the pressure variation can be attenuated by vibration of the damper sheet 72. Furthermore, excess displacement of the damper sheet 72 toward the oval recess 71*c* is restricted by the bottom of the oval recess 71*c*.

Therefore, the damper sheet 72 is prevented from being damaged. The bottom of the oval recess 71*c* prevents an external force, which may break the damper sheet 72, from being applied to the sheet.

Figure 6:
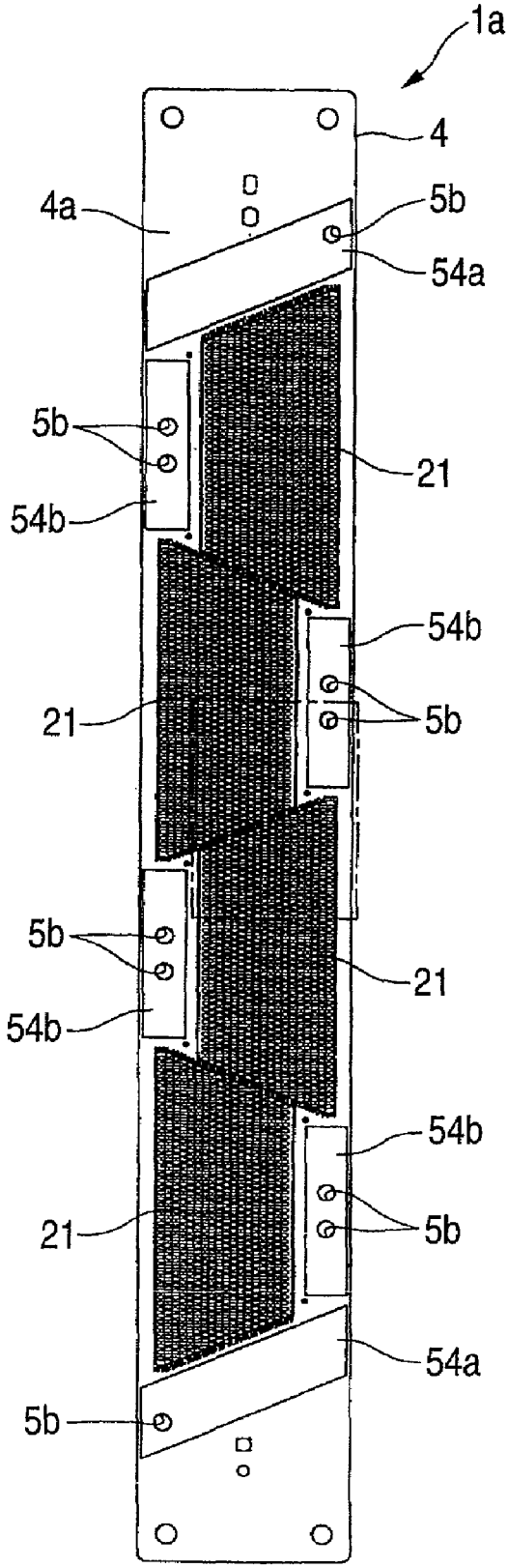
FIG. 6 is a plan view of the head body shown in FIG. 1.

Next, the thin film filters 54*a*, 54*b* and the head body 1*a* will be described with reference to FIG. 6. FIG. 6 is a plan view of the head body 1*a* to which the thin film filters 54*a*, 54*b* are joined. As shown in FIG. 6, the head body 1*a* includes the flow path unit 4 and the four actuator units 21, which are fixed to the upper face of the flow path unit 4.

The flow path unit 4 has a substantially rectangular parallelepiped external shape, which has an approximately same width as the reservoir unit 70, and which has a length in the main scanning direction substantially equal to the length of a stack structure formed by the fifth to eighth plates 75 to 78 of the reservoir unit 70. As described later, the flow path unit 4 is formed with a manifold flow path 5 and many individual ink flow paths 32, which communicate with the manifold flow path 5, and each of which includes a pressure chamber 10 and a nozzle 8 (see FIG. 8). The upper face of the flow path unit 4 functions as an inflow-port face 4*a* in which ten ink inflow ports 5*b* communicating with the manifold flow path 5 are formed. The ink inflow ports 5*b* are placed so as to correspond to the ink supply ports 59 of the circular holes 78*a* formed in the eighth plate 78. Namely, five ink inflow ports 5*b* are arranged in the longitudinal direction in the vicinity of each of the width ends of the flow path unit 4. Specifically, one, two, and two ink flow ports 5*b* are arranged in the one width end in order from one end side (the upper side of FIG. 6) in the longitudinal direction, and one, two, and two ink flow ports 5*b* are arranged in the other width end in order from the other end side (the lower side of FIG. 6) in the longitudinal direction, so as to be separated from each other in a staggered manner.

The actuator units 21 have a function of selectively applying an ejection energy to the ink in the pressure chambers 10 formed in the flow path unit 4, and have a trapezoidal plan shape. In the inflow-port face 4*a* of the flow path unit 4, the four actuator units 21 are placed in a staggered pattern so as to avoid the ink inflow ports 5*b*.

In each of the actuator units 21, the parallel opposing sides extend along the longitudinal direction of the flow path unit 4. Oblique sides of adjacent actuator units 21 overlap with each other with respect to the width direction of the flow path unit 4. The four actuator units 21 have a relative positional relationship in which the actuator units 21 are separated by the same distance from the center of the flow path unit 4 in the width direction toward the opposite sides. The actuator units 21 are placed in a region, which faces the first region 58 of the reservoir unit 70. The FPCs 50 connected to the actuator units 21 are withdrawn from the longer ones of the parallel opposing sides of the actuator unit 21.

The thin film filters 54*a*, 54*b* are thin films having: an ink not-passing region, which does not allow the ink to pass therethrough; and an ink passing region, which allows the ink to pass therethrough while filtering dust and the like in the ink. The thin film filters 54*a*, 54*b* are joined by an adhesive agent to the second regions 57 of the reservoir unit 70 and to the inflow-port face 4*a* of the flow path unit. At this time, the ink passing regions of the thin film filters 54*a*, 54*b* are sandwiched between the ink supply ports 59 opening in the second regions 57 and the corresponding ink inflow ports 5*b* opening in the inflow-port face 4*a* of the flow path unit 4.

The thin film filters 54*a* are placed to correspond to the ink inflow ports 5*b* respectively formed in the vicinities of the ends of the flow path unit 4 in the longitudinal direction. The think film filters 54*a* extend in a band-like manner over the whole region in the short side direction of the flow path unit 4. Each of the thin film filters 54*b* is placed between the thin film filters 54*a* so as to cover two of the ink inflow ports 5*b*, which are arranged in a staggered pattern. At this time, no actuator unit 21 is located between a certain thin film filters 54*a* and a thin film filters 54*b* closest to the certain thin film filter 54*a*. An actuator unit 21 is present between a certain thin film filter 54*a* and a thin film filter 54*b* other than the thin film filter 54*b* closest to the certain thin film filter 54*a*. An actuator unit 21 is present between the thin film filters 54*b*.

Next, the flow path unit 4 and the actuator units 21 will be described in detail with further reference to FIGS. 7 to 10. FIG. 7 is an enlarged view of the region enclosed by the one-dot chain line in FIG. 6. In FIG. 7, for the sake of convenience in description, the nozzles 8, pressure chambers 10, and apertures 12, which are placed below the actuator units 21, and which are to be drawn by broken lines, are drawn by solid lines.

Figure 8:
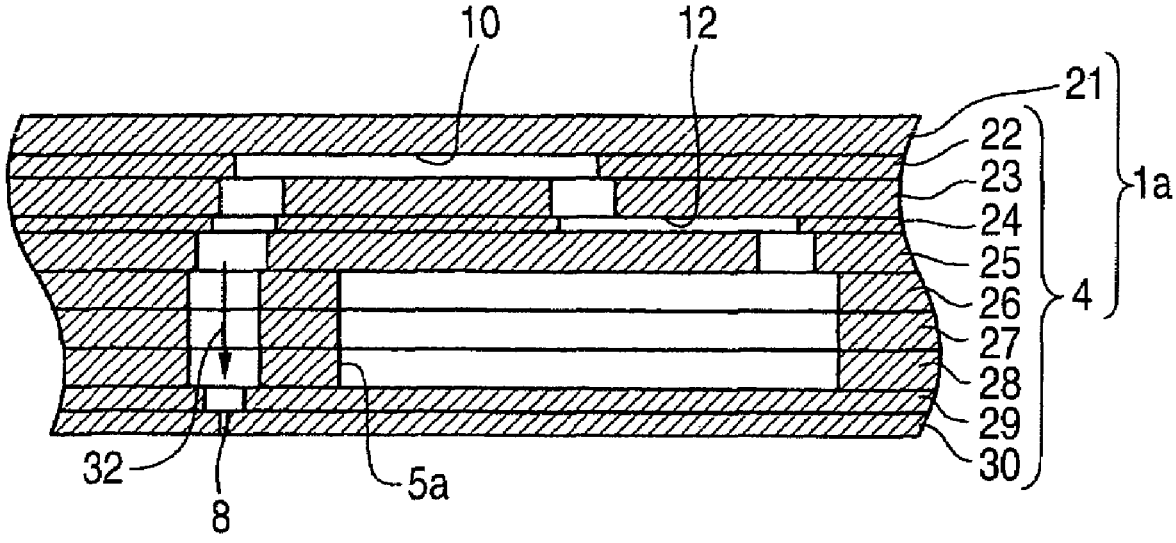
FIG. 8 is a partial section view taken along a line VIII-VIII in FIG. 7.
Figure 9:
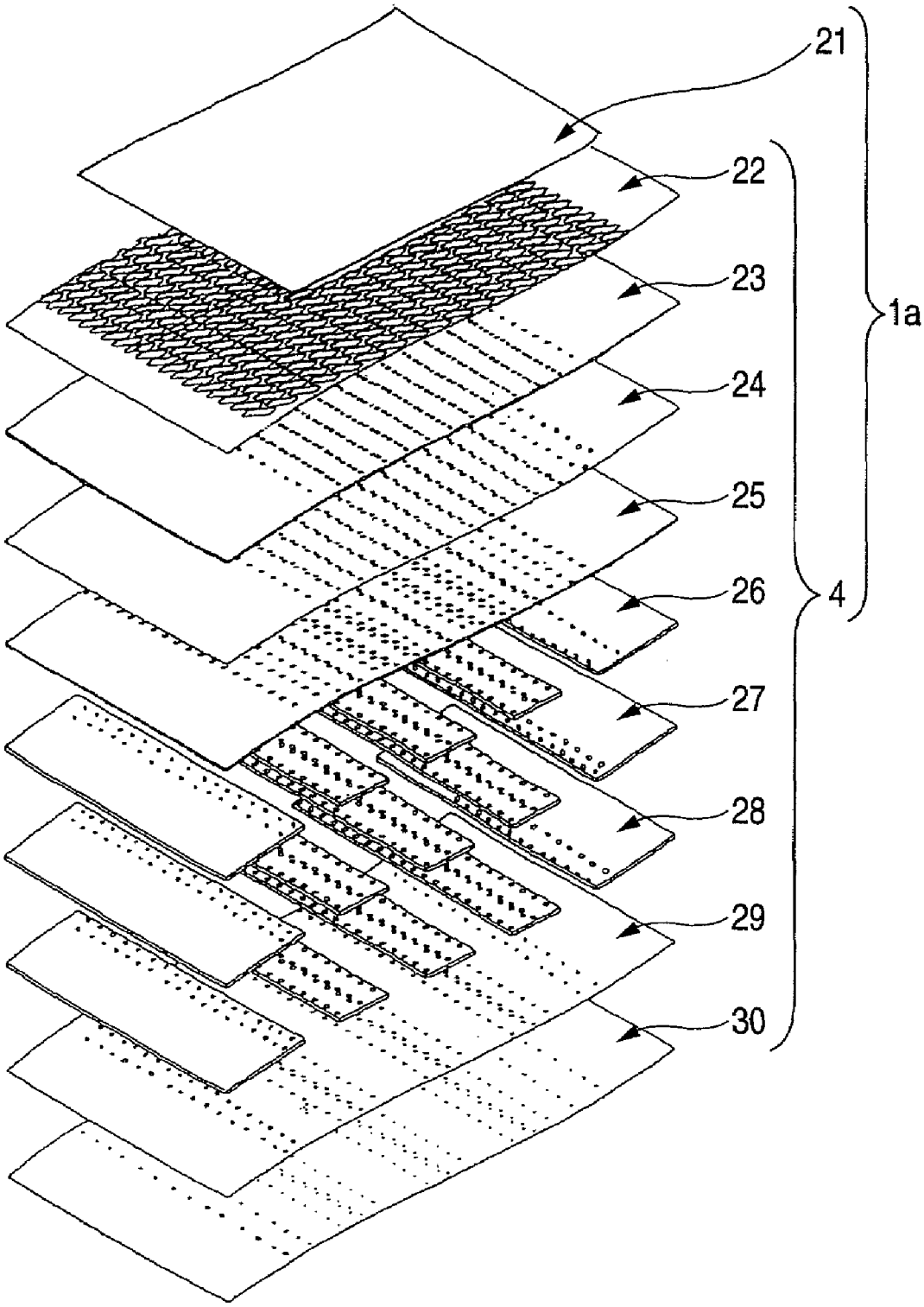
FIG. 9 is a partial exploded perspective view of the head body shown in FIG. 1.
Figure 10A:
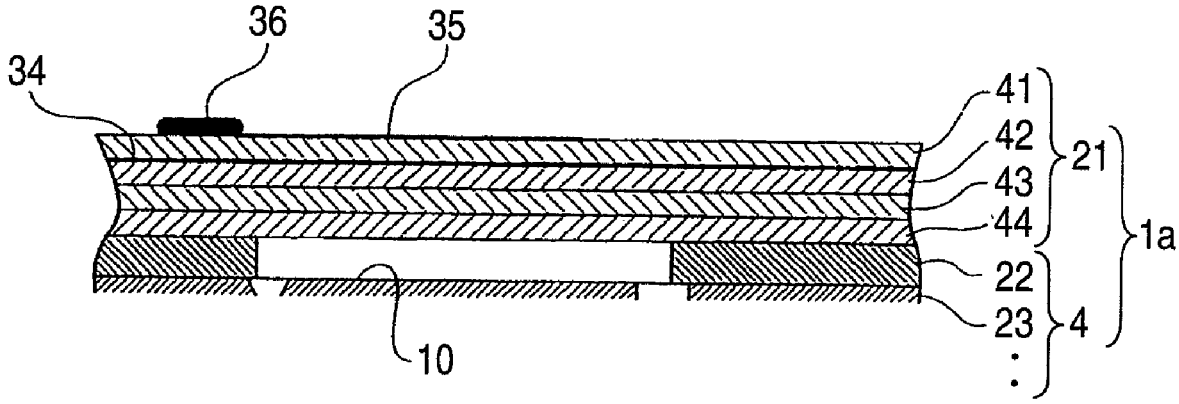
FIG. 10A is an enlarged section view of an actuator unit shown in FIG. 9.
Figure 10B:
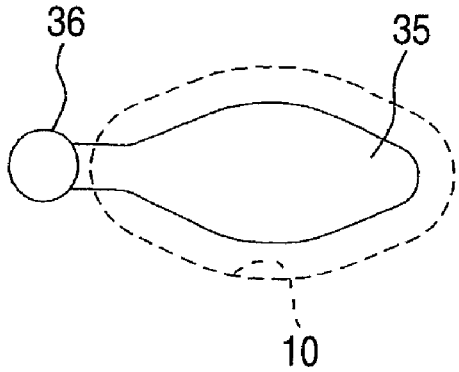
FIG. 10B is a plan view showing an individual electrode placed on a surface of the actuator unit in FIG. 10A.

FIG. 8 is a partial section view taken along a line VIII-VIII shown in FIG. 7. FIG. 9 is a partial exploded perspective view of the head body 1*a*. FIG. 10A is an enlarged section view of the actuator unit 21. FIG. 10B is a plan view showing an individual electrode 35 placed on the surface of the actuator unit 21 in FIG. 10A.

On the lower face of the flow path unit 4, as shown in FIGS. 7 and 8, ink ejection surface in which the many nozzles 8 are arranged in a matrix are formed. In a region corresponding to the ink ejection surface, also the pressure chambers 10 are arranged in a large number in a matrix in a similar manner as the nozzles 8. In this embodiment, namely, the ink ejection surface in which the nozzles 8 are open in a matrix, and the surface in which the pressure chambers 10 are arranged in a matrix constitute a pair of opposing surfaces of the flow path unit 4. A plurality of individual ink flow paths 32, which will be described later, are formed in the flow path unit 4 so as to be sandwiched between the pair of faces. The actuator units 21 are fixed together with the thin film filters 54*a*, 54*b* onto the surface in which the pressure chambers 10 are arranged.

As shown in FIG. 9, the flow path unit 4 is formed by nine metal plates which are a cavity plate 22, a base plate 23, an aperture plate 24, a supply plate 25, manifold plates 26, 27, 28, a cover plate 29, and a nozzle plate 30 in order from its top. These plates 22 to 30 have a rectangular plane, which elongate in the main scanning direction (see FIG. 1).

In the cavity plate 22, through holes, which correspond to the ink inflow ports 5*b* (see FIG. 6), and those, which correspond to the pressure chambers 10 and have a substantially rhombus shape, are formed in a large number. In the base plate 23, for each of the pressure chambers 10, a communication hole between the pressure chamber 10 and the aperture 12, and that between the pressure chamber 10 and the nozzle 8 are formed, and communication holes between the ink inflow ports 5*b* and the manifold flow path 5 are formed. In the aperture plate 24, for each of the pressure chambers 10, a through hole corresponding to the aperture 12, and a communication hole between the pressure chamber 10 and the nozzle 8 are formed, and communication holes between the ink inflow ports 5*b* and the manifold flow path 5 are formed. In the supply plate 25, for each of the pressure chambers 10, a communication hole between the aperture 12 and a sub-manifold flow path 5*a*, and a communication hole between the pressure chamber 10 and the nozzle 8 are formed, and communication holes between the ink inflow ports 5*b* and the manifold flow path 5 are formed. In the manifold plates 26, 27, 28, for each of the pressure chambers 10, a communication hole between the pressure chamber 10 and the nozzle 8, and through holes which, when the plates are stacked, communicate with each other to be formed as the manifold flow path 5 and the sub-manifold flow path 5*a* are formed. In the cover plate 29, for each of the pressure chambers 10, a communication hole between the pressure chamber 10 and the nozzle 8 is formed. In the nozzle plate 30, for each of the pressure chambers 10, a hole corresponding to the nozzle 8 is formed.

The nine plates 22 to 30 are stacked and fixed to each other while being positioned so that the individual ink flow paths 32 such as shown in FIG. 8 are formed in the flow path unit 4.

Inside the flow path unit 4, the manifold flow path 5 communicating with the ink inflow ports 5*b*, and the sub-manifold flow path 5*a* branched from the manifold flow path 5 are formed. For each of the nozzles 8, the individual ink flow path 32 such as shown in FIG. 8, which passes from the manifold flow path 5 through the sub-manifold flow path 5*a* and the pressure chamber 10 to reach the nozzle 8 is formed. The ink, which is supplied from the reservoir unit 70 into the flow path unit 4 through the ink inflow ports 5*b*, is branched from the manifold flow path 5 to the sub-manifold flow path 5*a*, and reaches the nozzle 8 through the aperture 12, which functions as an orifice, and the pressure chamber 10.

Each of the actuator units 21 is configured by four piezoelectric sheets 41, 42, 43, 44, which are made of a ferroelectric ceramic material of lead zirconate titanate (PZT), and which have a thickness of about 15 μm (see FIG. 10A). The thickness of the actuator units 21 in a direction perpendicular to the inflow-port face 4*a* of the flow path unit 4 is larger than the thicknesses of the thin film filters 54*a*, 54*b* (see FIG. 11). The piezoelectric sheets 41 to 44 are placed over the many pressure chambers 10, which are formed to correspond to one ink ejection surface.

Individual electrodes 35 are formed in positions on the uppermost piezoelectric sheet 41 and corresponding to the pressure chambers 10. A common electrode 34, which is over the whole sheet and has a thickness of about 2 μm, is sandwiched between the uppermost piezoelectric sheet 41 and the piezoelectric sheet 42, which is below the piezoelectric sheet 41. The individual electrodes 35 and the common electrode 34 are made of a metal material such as Ag-Pd. No electrode is placed between the piezoelectric sheets 42, 43, and between the piezoelectric sheets 43, 44.

Each of the individual electrodes 35 has a thickness of about 1 μm. As shown in FIG. 10B, each of the individual electrodes 35 has a substantially rhombus plan shape, which is similar to the plan shape of the pressure chambers 10. One of the acute angle portions of the individual electrode 35 having a substantially rhombus shape is elongated. A circular land 36, which is electrically connected to the individual electrode 35 and has a diameter of about 160 μm, is disposed at the tip end of the elongated portion. The land 36 is made of gold, which contains, for example, a glass frit. As shown in FIG. 10A, the land 36 is formed in a position, which is on the elongated portion of the individual electrode 35 and is opposed to the wall of the cavity plate 22 defining the pressure chamber 10 with respect to the thickness direction of the piezoelectric sheets 41 to 44, i.e., the position, which does not overlap with the pressure chamber 10. The land 36 is electrically joined to a contact disposed on the FPC 50 (see FIG. 2).

The common electrode 34 is grounded in a region, which is not shown. Therefore, the common electrode 34 is equally kept to the ground potential in a region corresponding to all the pressure chambers 10. By contrast, the individual electrodes 35 (the lands 36) are connected to the driver ICs 83 through the FPCs 50 including other lead lines, which are independent for the individual electrodes 35, in order to enable their potentials to be selectively controlled (see FIG. 2).

Hereinafter, a method of driving the actuator units 21 will be described.

The piezoelectric sheet 41 is polarized in the thickness direction. When one of the individual electrodes 35 is set to a potential different from that of the common electrode 34 and an electric field is applied to the piezoelectric sheet 41 in the polarization direction, a portion of the piezoelectric sheet 41 to which the electric field is applied operates as an active portion, which is distorted by the piezoelectric effect. Namely, the piezoelectric sheet 41 is extended or contracted in the thickness direction, and contracted or extended in the planar direction by the piezoelectric transverse effect. By contrast, the remaining three piezoelectric sheets 42 to 44 are inactive layers, which have no region sandwiched between the individual electrodes 35 and the common electrode 34 and thus cannot be spontaneously deformed.

Namely, each of the actuator units 21 is of the so-called unimorph type in which the upper one piezoelectric sheet 41 that is apart from the pressure chamber 10 is formed as a layer including the active layer, and the lower three piezoelectric sheets 42 to 44 that are close to the pressure chambers 10 are formed as the inactive layers. As shown in FIG. 10A, the piezoelectric sheets 41 to 44 are fixed to the upper face of the cavity plate 22 defining the pressure chamber 10. When a difference in distortion in the planar direction is produced between the electric field applied portion of the piezoelectric sheet 41 and the lower piezoelectric sheets 42 to 44, therefore, the whole piezoelectric sheets 41 to 44 are deformed so as to be convexed toward the pressure chamber 10 (unimorph deformation). As a result, the volume of the pressure chamber 10 is reduced to increase the pressure in the pressure chamber 10, the ink is pushed out from the pressure chamber 10 into the nozzle 8, and the ink is ejected from the nozzle 8.

When the individual electrode 35 is thereafter returned to the same potential as the common electrode 34, the piezoelectric sheets 41 to 44 are caused to have the original flat shape, and the volume of the pressure chamber 10 is returned to the original value. In accordance with this, the ink is introduced from the manifold flow path 5 into the pressure chamber 10, and the ink is again stored in the pressure chamber 10.

Figure 11:
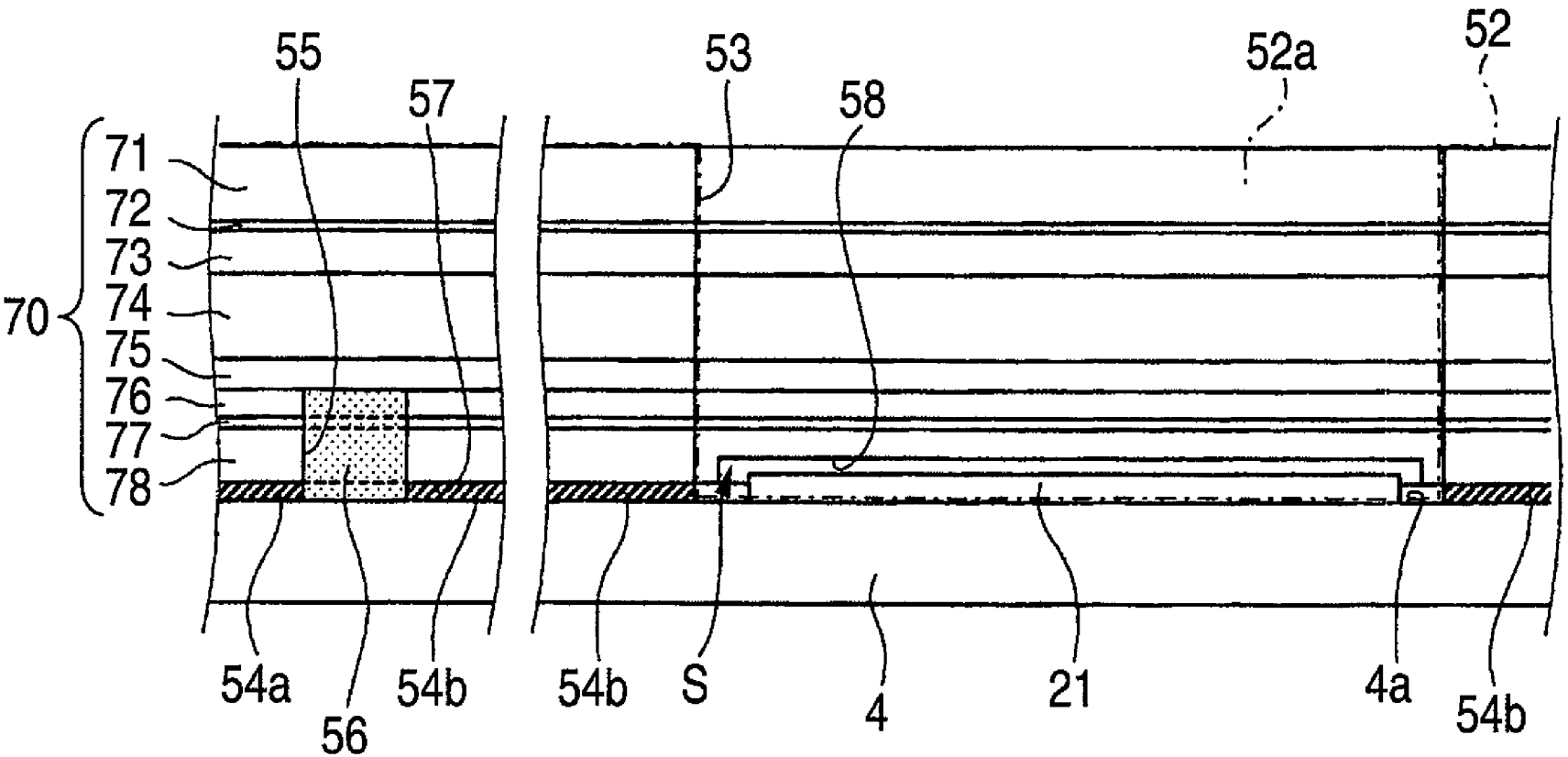
FIG. 11 is a partial side view of the inkjet head shown in FIG. 1.

Next, positional relationships among the reservoir unit 70, the thin film filters 54*a*, 54*b*, and the head body 1*a* will be described with reference to FIG. 11. FIG. 11 is a partial enlarged side view of the inkjet head 1. In FIG. 11, for the sake of convenience in description, the lower cover 52 is indicated by a one-dot chain line, and illustration of the FPCs 50 is omitted. As shown in FIG. 11, the reservoir unit 70 and the flow path unit 4 are joined together through the thin film filters 54*a*, 54*b*, whereby a space S where the actuator units 21 is placed is formed between the first region 58 of the reservoir unit 70 and the inflow-port face 4*a* of the flow path unit 4 (see FIG. 2). At this time, a plurality of gaps, which communicate with the space S, are formed between the thin film filters 54*a* and the thin film filters 54*b*, and between the thin film filters 54*b*. Among the gaps, gaps between the thin film filters 54*a* and the thin film filters 54*b* and between the thin film filters 54*b*—where the longer parallel opposing sides of the actuator units 21 are exposed—are covered by the projections 52*a* of the lower cover 52 placed in the recesses 53 and sealed by a sealant applied between the lower end faces of the projections 52*a* and the flow path unit 4. On the side of the shorter parallel opposing sides of the actuator units 21, gaps between the thin film filters 54*a* and the thin film filters 54*b* closest to the thin film filters 54*a* are sealed by applying a sealant 56 made of a soft material to the recesses 55. In this embodiment, the gaps, which are open toward the recesses 55, between the thin film filters 54*a* and the thin film filters 54*b*, the gaps between the thin film filters 54*b*, and a portion between (i) the lower end face of the lower cover 52 and (ii) the reservoir unit 70 and the flow path unit 4 (more specifically, the portion along the one-dot chain line indicating the lower cover 52 in FIG. 11) are sealed by the sealant. Particularly, all gaps, which tend to be widened, between the thin film filters 54*a* and the thin film filters 54*b*, and gaps between the thin film filters 54*b* are sealed. Hence, ink mist do not enter the space S through the gaps. According to this configuration, it is possible to prevent the actuator units 21 from being damaged by ink mist.

As described above, according to the inkjet head 1 of this embodiment, entering of dust or the like into the individual ink flow paths 32 can be suppressed with the simple configuration in which the thin film filters 54*a*, 54*b* are placed between the flow path unit 4 and the reservoir unit 70. Since the recess 55 is formed on the side face of the reservoir unit 70, the sealant 56 for sealing the gaps between the thin film filters 54*a* and the thin film filters 54*b* closest to the thin film filters 54*a* can be easily applied. At this time, the sealant 56 may be applied only to a limited portion, i.e., the recess 55. Hence, a situation where the sealant 56 flows into or protrudes into another portion does not occur. Since the gaps between the thin film filters 54*a* and the thin film filters 54*b* closest to the thin film filters 54*a* are sealed by the sealant 56, the lower cover 52 is not necessary to cover the gaps between the thin film filters 54*a* and the thin film filters 54*b* closest to the thin film filters 54*a*. Therefore, the width of the lower cover 52 is not widened to be larger than that of the flow path unit 4, and the inkjet head 1 can be miniaturized. Furthermore, an easily breakable part is eliminated from the projections 52*a* of the lower cover 52. Therefore, the production yield can be improved.

The thickness of the actuator units 21 in the direction perpendicular to the inflow-port face 4*a* of the flow path unit 4 is larger than the thicknesses of the thin film filters 54*a*, 54*b*. Even after the actuator unit 21 and the thin film filters 54*a*, 54*b* are fixed to the inflow-port face 4*a* of the flow path unit 4, therefore, the individual electrodes 35 and the lands 36 can be easily formed on the actuator unit 21. Irrespective of such thickness relationships among the actuator units 21 and the thin film filters 54*a*, 54*b*, the configuration in which the thin film filters 54*a*, 54*b* are placed on the inflow-port face 4*a* can prevent dust, dirt, a foreign material, or the like, which may be produced when the individual electrodes 35 and the land 36 are formed on the actuator units 21, from entering the flow path unit 4.

In the second regions 57 of the reservoir unit 70, the whole circumferences of the outer edges of the thin film filters 54*a*, 54*b*, which cover the ink supply ports 59 of the circular holes 78*a*, abut against the non-groove region 57*b*. Therefore, the outer edges of the thin film filters 54*a*, 54*b* are in close contact with the non-groove region 57*b*.

According to this configuration, ink mist entering between the flow path unit 4 and the reservoir unit 70 do not reach the actuator unit 21 through the lattice-like grooves of the groove region 57*a*.

In the above, one embodiment of the invention has been described. However, the invention is not limited to the above-described embodiment, and the design may be variously modified within the scope of the claims. For example, the above embodiment is configured so that the thickness of the actuator units 21 in the direction perpendicular to the inflow-port face 4*a* of the flow path unit 4 is larger than the thicknesses of the thin film filters 54*a*, 54*b*. Alternatively, the thickness of the actuator units 21 may be equal to the thicknesses of the thin film filters 54*a*, 54*b*, or smaller than the thicknesses of the thin film filters 54*a*, 54*b*.

In the above-described embodiment, the whole circumferences of the outer edges of the thin film filters 54*a*, 54*b* abut against the non-groove region 57*b* in the second regions 57 of the reservoir unit 70. Alternatively, only parts of the outer edges of the thin film filters 54*a*, 54*b* may abut against the non-groove region 57*b*. From a viewpoint that entering of splashes or mist of ink from the outside is prevented from occurring, the outer edges of the thin film filters 54*a*, 54*b* may abut against the non-groove region 57*b* in the vicinities of the width ends of the flow path unit 4. From another viewpoint that both ink from the outside and ink from the ink inflow ports 5*b* or the ink supply ports 59 are prevented from entering the actuator units 21 in which electrical connecting portions exist, the outer edges of the thin film filters 54*a*, 54*b* may abut against the non-groove region 57*b* so as to have an approximately C-like shape, which surrounds the ink inflow ports 5*b* or the ink supply ports 59 from portions adjacent to the width ends of the flow path unit 4.

The whole circumferences of the outer edges of the thin film filters 54*a*, 54*b* may not abut against the non-groove region 57*b*. According to this configuration, the degree of freedom of the regions where the thin film filters 54*a*, 54*b* are to be placed is enhanced, and the thin film filters 54*a*, 54*b* can be easily placed.

Figure 12:
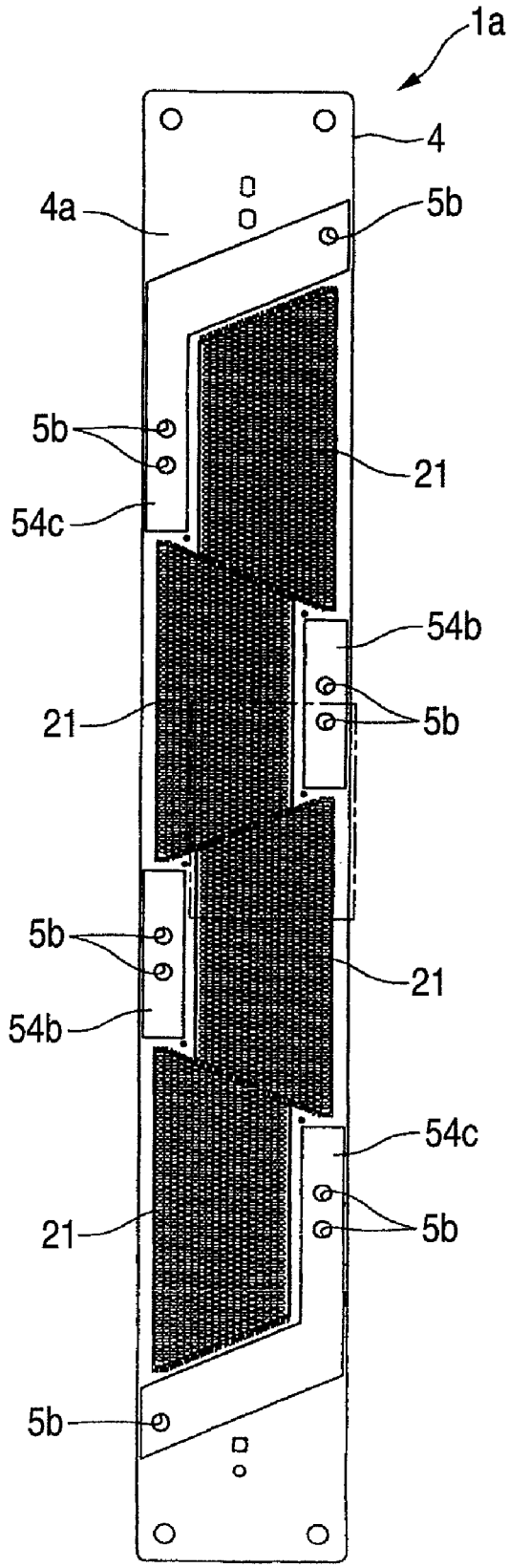
FIG. 12 is a plan view of a head body according to another embodiment, and corresponds to FIG. 6.

In the above-described embodiment, the recesses 55 are formed in the side faces of the reservoir unit 70, and (i) the gap between each filter 54*a* and the filter 54*b* closest to each filter 54*a* and (ii) the recesses 55 are sealed with the sealant 56. However, the invention is not limited to this configuration. In another embodiment, in place of each filter 54*a* and the filter 54*b* closest to each filter 54*a*, an integrated filter 54*c* may be used as shown in FIG. 12. As shown in FIG. 12, the actuator units 21 are arranged on the inflow-port face 4*a* of the flow path unit 4 in a row in the longitudinal direction of the flow path unit 4. The filters 54*b* are disposed between the actuator units 21. The filters 54*c* are disposed outside the row of the actuator units 21. Specifically, each filter 54*c* extends along two adjacent sides of the actuator unit 21, which is located at a corresponding end of the row of the actuator units (21).

Figure 13:
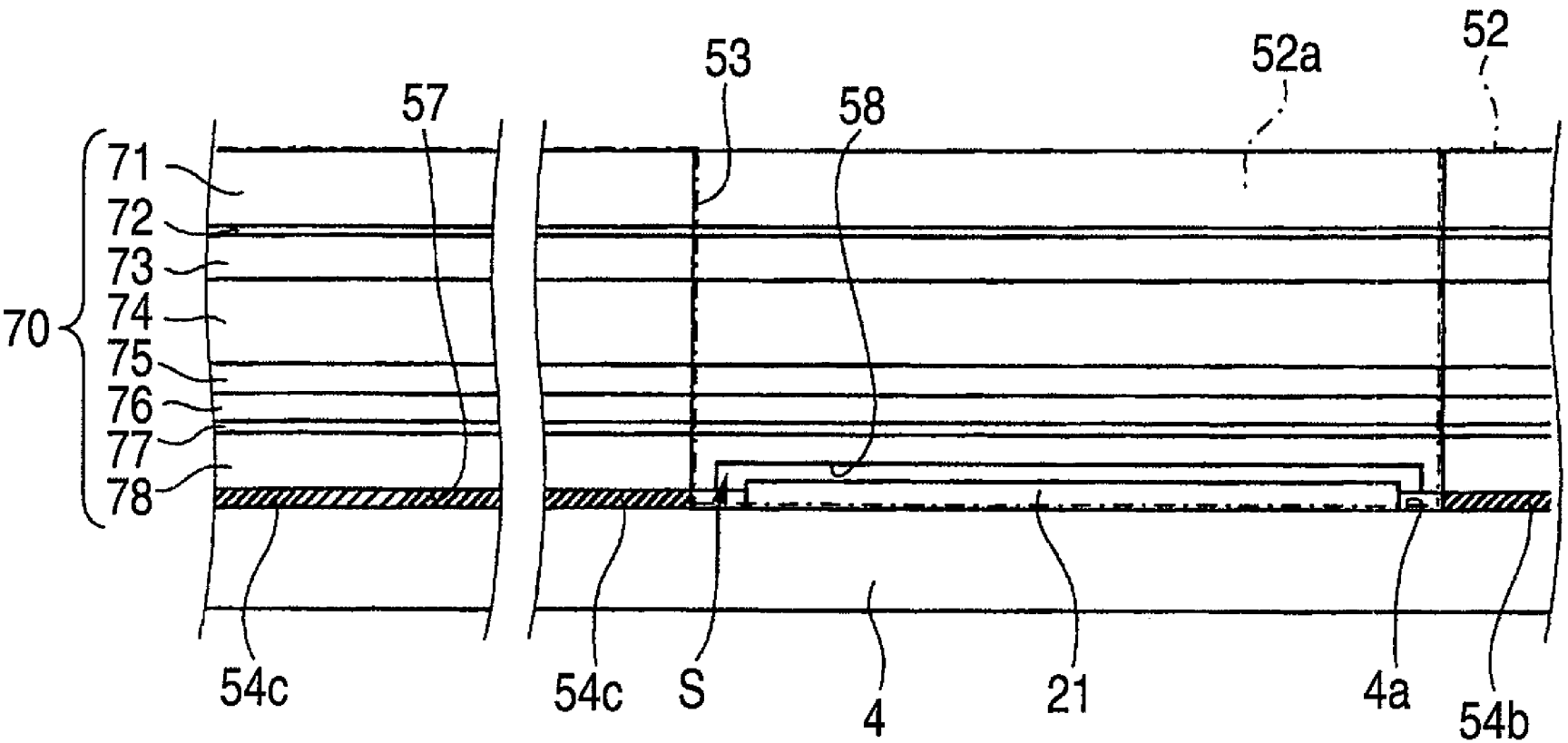
FIG. 13 is a partial side view of an inkjet head according to the another embodiment, and corresponds to FIG. 11.

Although the filter 54*a* and the filter 54*b* closest to the filter 54*a* are separate from each other and the gap is formed therebetween in the above-described embodiment, each filter 54*c* is a single part in the another embodiment. Therefore, as shown in FIG. 13, the reservoir unit 70 of this embodiment is not formed with the recess 55.

The gaps between the ends of the projections 52*a* of the cover member 52 and the inflow-port face 4*a* of the flow path unit 4 are sealed with the sealant. Thus, a combination of the filters 54*b*, 54*c* and the sealant surrounds the row of the actuator units 21 (i.e., a circumference of a group of the four actuator units 21).

Since each integrated filter 54*c* is the single part, it is not necessary to seal the gap between each filter 54*a* and the corresponding filter 54*b* closets to the filter 54*a* with the sealant. Furthermore, it is not necessary to form the recesses 55 in the side faces of the reservoir unit 70.

According to the another embodiment, the reservoir unit 70, which has a simpler configuration (that is, has no recess 55), can prevent ink mist from entering the space S. Therefore, it is possible to prevent the actuator units 21 from being damaged by ink mist.

The inkjet head of the invention is not limited to the piezoelectric type inkjet head having the actuator units 21, and may be a thermal type inkjet head, or an electrostatic type inkjet head.

The application of the inkjet head of the invention is not limited to a printer, and the inkjet head may be applied to an inkjet facsimile apparatus or copier.

What is claimed is:

1. An inkjet head comprising:

a flow path unit that comprises:

an inflow-port face formed with a plurality of ink inflow ports; and a plurality of nozzles that communicate with the ink flow ports;

an actuator unit that applies an ejection energy to ink in the flow path unit to eject the ink through the nozzles the actuator unit joined to the inflow-port face of the flow path unit;

a plurality of filters joined to the inflow-port face of the flow path unit to cover the ink inflow ports; and a reservoir unit formed with an ink reservoir that stores the ink, the reservoir unit comprising a plurality of ink supply ports, the reservoir unit that supplies the ink to the flow path unit through the ink supply ports, the filters and the ink inflow ports, wherein:

the ink supply ports of the reservoir unit and the ink inflow ports of the flow path unit sandwich the filters therebetween, the actuator unit comprises a plurality of actuator units, the actuator units are arranged in a row, and the filters comprise a first filter, which is disposed between the actuator units, and a second filter, which extends along two adjacent sides of the actuator unit located at an end of the row of the actuator units.

2. The inkjet head according to claim 1, further comprising:

a cover member that faces a side face of the reservoir unit with a gap therebetween, wherein:

a gap between an end of the cover member and the inflow-port face of the flow path unit is sealed with a sealant, and a combination of the filters and the sealant surrounds the row of the actuator units.

* * * * *